United States Patent [19]

Thornell

[11] Patent Number: 4,793,611

[45] Date of Patent: Dec. 27, 1988

[54] ADJUSTABLE HEIGHT TOY BASKETBALL GOAL

[75] Inventor: Ernest L. Thornell, Booneville, Ark.

[73] Assignee: Spang & Company, Butler, Pa.

[21] Appl. No.: 905,536

[22] Filed: Sep. 10, 1986

[51] Int. Cl.[4] ..... A63B 63/08

[52] U.S. Cl. ..... 273/1.5 R; 16/343; 248/407; 248/DIG. 10; 403/104; 403/118; 411/143

[58] Field of Search ..... 273/1.5 R, 1.5 A; 248/161, 404, 405; 406.1, 407, 188.1, 188.5, 548, 549, 573, DIG. 10; 403/104–109, 348, 349, 320, 118; 411/141, 143; 16/221, 225–227, 231, 232, 292, 297, 319–323, 343–353, 333–336

[56] References Cited

U.S. PATENT DOCUMENTS

| | | | |
|---|---|---|---|
| 499,312 | 6/1893 | Turner | 403/320 X |
| 546,699 | 9/1895 | Kane | 403/104 |
| 704,077 | 7/1902 | McCauley | 16/334 |
| 1,412,039 | 4/1922 | Bowman | 16/334 X |
| 1,631,227 | 6/1927 | See | 248/188.1 |
| 1,635,566 | 7/1927 | Victorsohn | 16/322 X |
| 1,645,032 | 10/1927 | Wilson | 403/118 X |
| 1,717,718 | 6/1929 | Marshall et al. | 248/DIG. 10 X |
| 1,862,411 | 6/1932 | Mackenzie, Jr. | 16/336 X |
| 1,951,754 | 3/1934 | Gilbert | 248/407 X |
| 1,970,525 | 8/1934 | Lyons | 411/143 X |
| 2,278,616 | 4/1942 | Kettering | 273/1.5 R |
| 2,379,572 | 7/1945 | Gibson | 273/1.5 R X |
| 2,483,376 | 10/1949 | Benson | 403/109 X |
| 2,693,358 | 11/1954 | Dawson, Jr. | 248/407 X |
| 2,986,395 | 5/1961 | Sheftel | 273/1.5 R |
| 3,017,183 | 1/1962 | Chalcroft | 273/1.5 R |
| 3,602,504 | 8/1971 | Chadman | 273/1.5 R |
| 3,841,631 | 10/1974 | Dolan | 273/1.5 R |
| 4,145,044 | 3/1979 | Wilson et al. | 273/1.5 R |
| 4,151,989 | 5/1979 | Dittrich | 273/1.5 A |
| 4,365,802 | 12/1982 | Ehrat | 273/1.5 R |
| 4,395,040 | 7/1983 | White | 273/1.5 R |
| 4,465,277 | 8/1984 | Dittrich | 273/1.5 A |
| 4,522,394 | 6/1985 | Broussard | 273/1.5 R |
| 4,534,556 | 8/1985 | Estlund | 273/1.5 R |
| 4,583,732 | 4/1986 | Allen | 273/1.5 R |
| 4,676,503 | 6/1987 | Mahoney et al. | 273/1.5 R |

*Primary Examiner*—Paul E. Shapiro

*Attorney, Agent, or Firm*—Kirkpatrick & Lockhart

[57] ABSTRACT

Portable, lightweight-construction toy basketball set made of releasably interlocking plastic parts for ease of assembly and disassembly in which backboard structure and a base support are interconnected by an elongated upright standard. An elongated upright is provided which is divisible into separate columns which interfit telescopically and present helically-oriented interrupted threads for ease of selection of upright height and release for further adjustment or separation of the columns. A bracket interconnects a hoop flange to the backboard with the bracket and hoop flange having matching interfitting configurations for yieldably releasing the hoop for angular relative movement with respect to such backboard so as to prevent damage to interfitted parts during execution of a slam dunk play and to permit angular relative movement for manually returning such hoop to normal play position. Net attachment means unitary with the interior rim of the hoop provide for safe and secure attachment of net string loops to the hoop.

5 Claims, 4 Drawing Sheets

FIG. 1
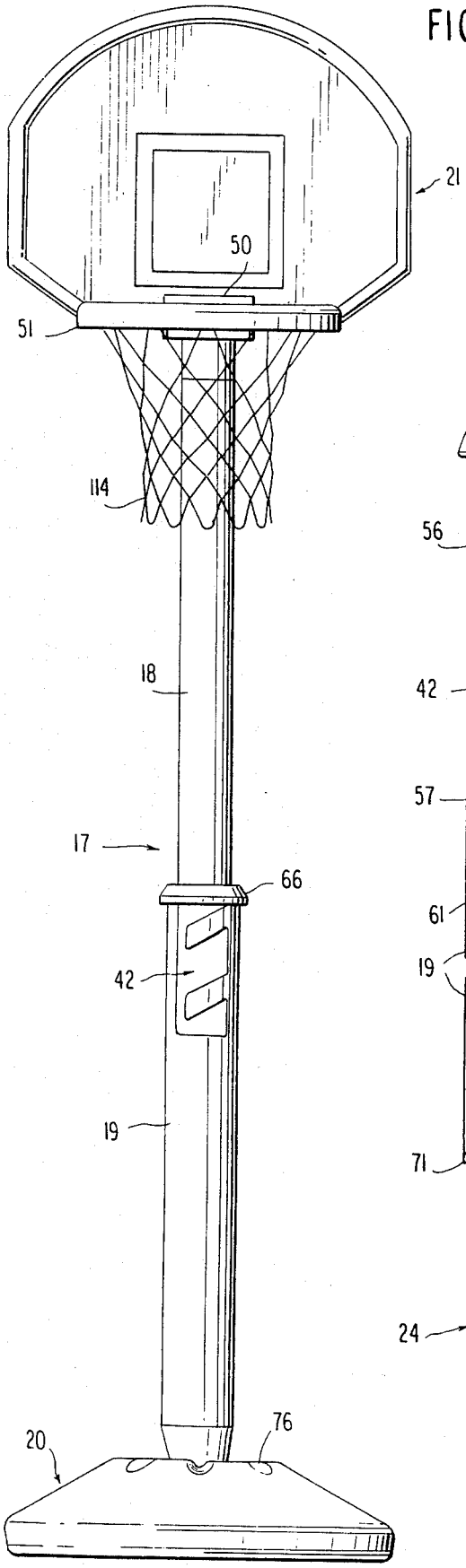
FIG. 3
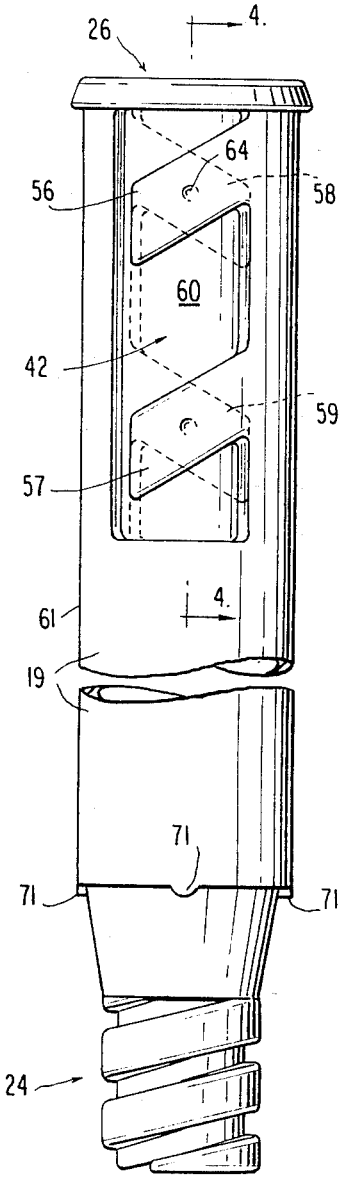
FIG. 4
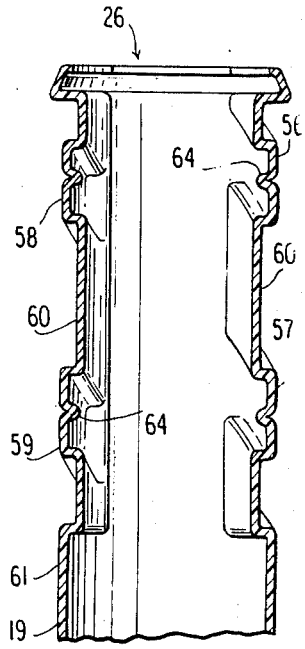
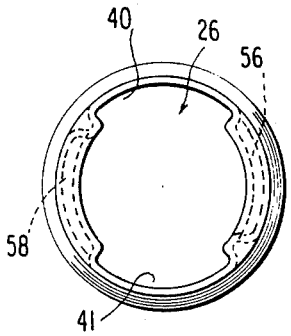
FIG. 5

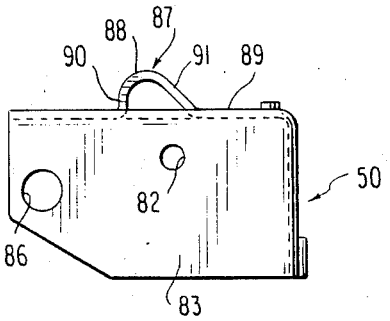
FIG. 12
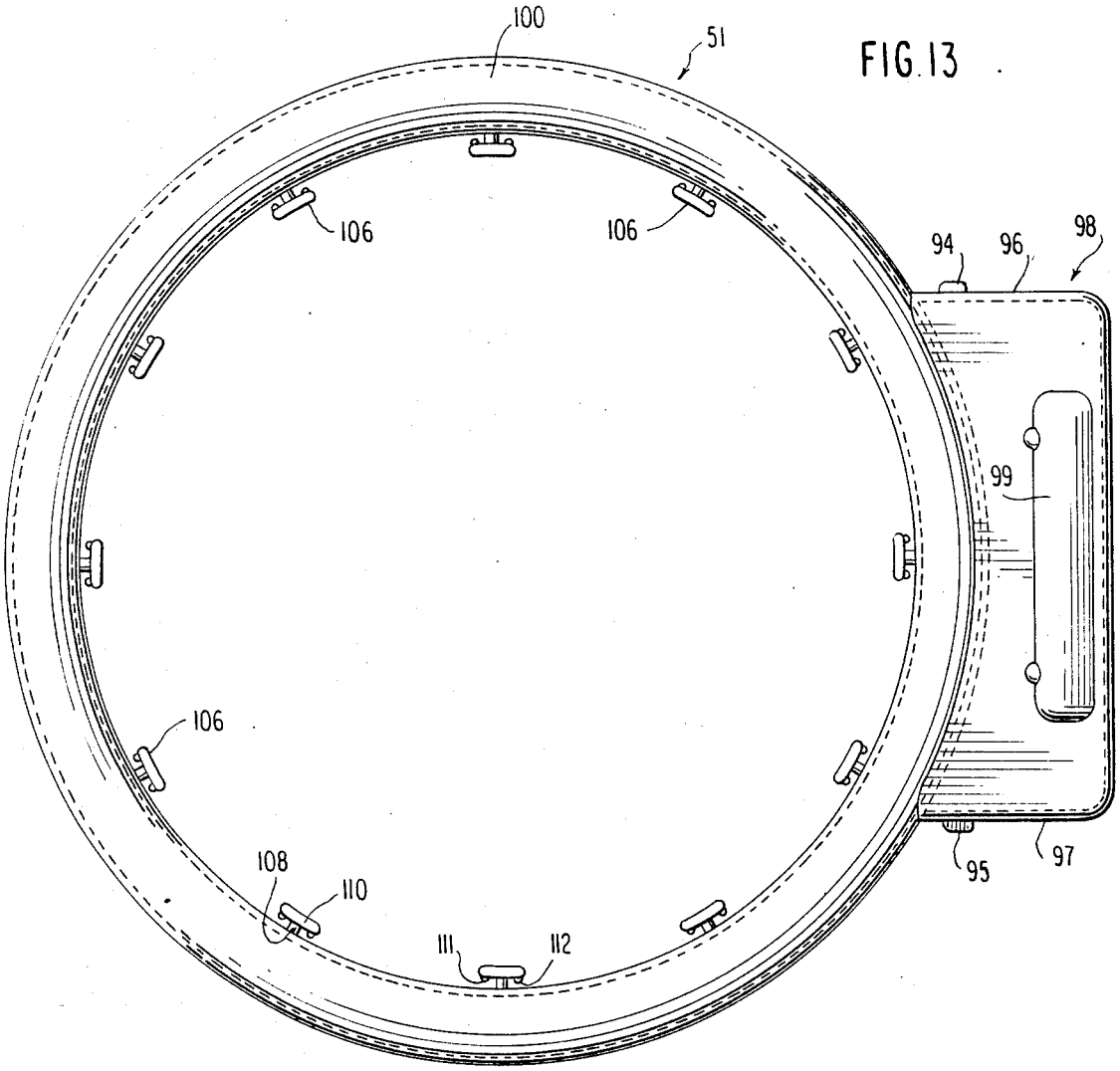
FIG. 13
FIG. 14
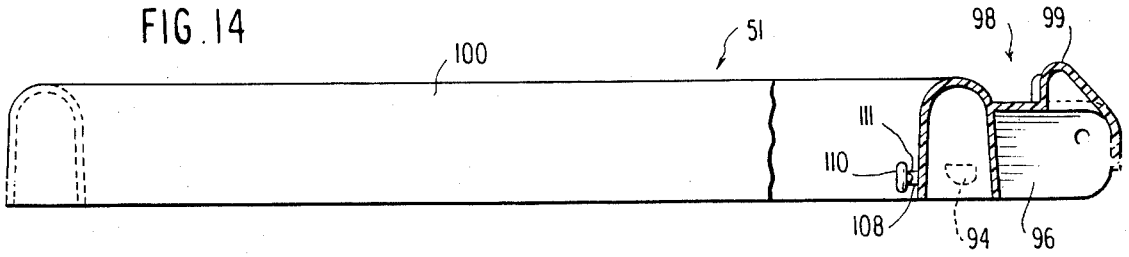

ADJUSTABLE HEIGHT TOY BASKETBALL GOAL

This invention relates to a toy basketball set with adjustable upright support for the basketball backboard and associated hoop structure. In its more specific aspects, the invention is concerned with a lightweight-construction, portable, toy basketball goal set with releasably interconnected plastic parts which can be easily assembled for use and easily disassembled to a suitable size convenient for transport.

The special height adjustment features for the columnar support of the invention are efficient and not prone to wear or deterioration, are especially adapted for hollow tubular construction and are easy to operate. Such adjustment features make the toy adaptable for use by children of different age groups: for example, dimensions are set forth later for a specific embodiment adaptable for use by age groups from about three years of age to about eight years of age or older.

The entire toy can be fabricated by known plastic molding practices, e.g. blow-molding providing hollow, lightweight, separable parts. The toy of the present invention is thus suitable for both indoor or outdoor usage since the materials and construction are not prone to deterioration due to exposure to the elements.

A "break-away" hoop feature permits hoop structure to be safely dislodged from its normal play position—thus preventing damage to the hoop or backboard, and avoiding tilting-over of the entire basketball goal set should a child clasp the hoop or net so as to apply undue weight load thereto. The hoop is manually returned to its play position after being dislodged. Such safe dislodgment and return of hoop structure can take place repeatedly without damage to any of the structure.

Also, special net fastening means located on the internal diameter rim of the hoop provides for secure placement of the net, without hooks or other hazards to safety, and helps avoid deterioration of the net during use.

These and other advantages and contributions of the invention are considered in more detail in relation to the accompanying drawings, in which:

FIG. 1 is a front elevational view of the assembled toy basketball goal set of the invention;

FIG. 3 is a detailed side view of one column of the elongated upright of the invention with portions on the opposite side of such column shown in interrupted lines;

FIG. 4 is a cross-sectional view of a portion of the column of column of FIG. 3 taken along the plane 4—4;

FIG. 5 is a plan view of an intermediate end of the column of FIG. 3 with portions shown in interrupted lines;

FIG. 12 is a side elevational view of the bracket means of FIG. 10;

FIG. 13 is a top plan view of releasable hoop structure to be mounted in the bracket means of FIG. 10;

FIG. 14 is a cross sectional view of the releasable hoop structure of FIG. 13.

Figure 2:
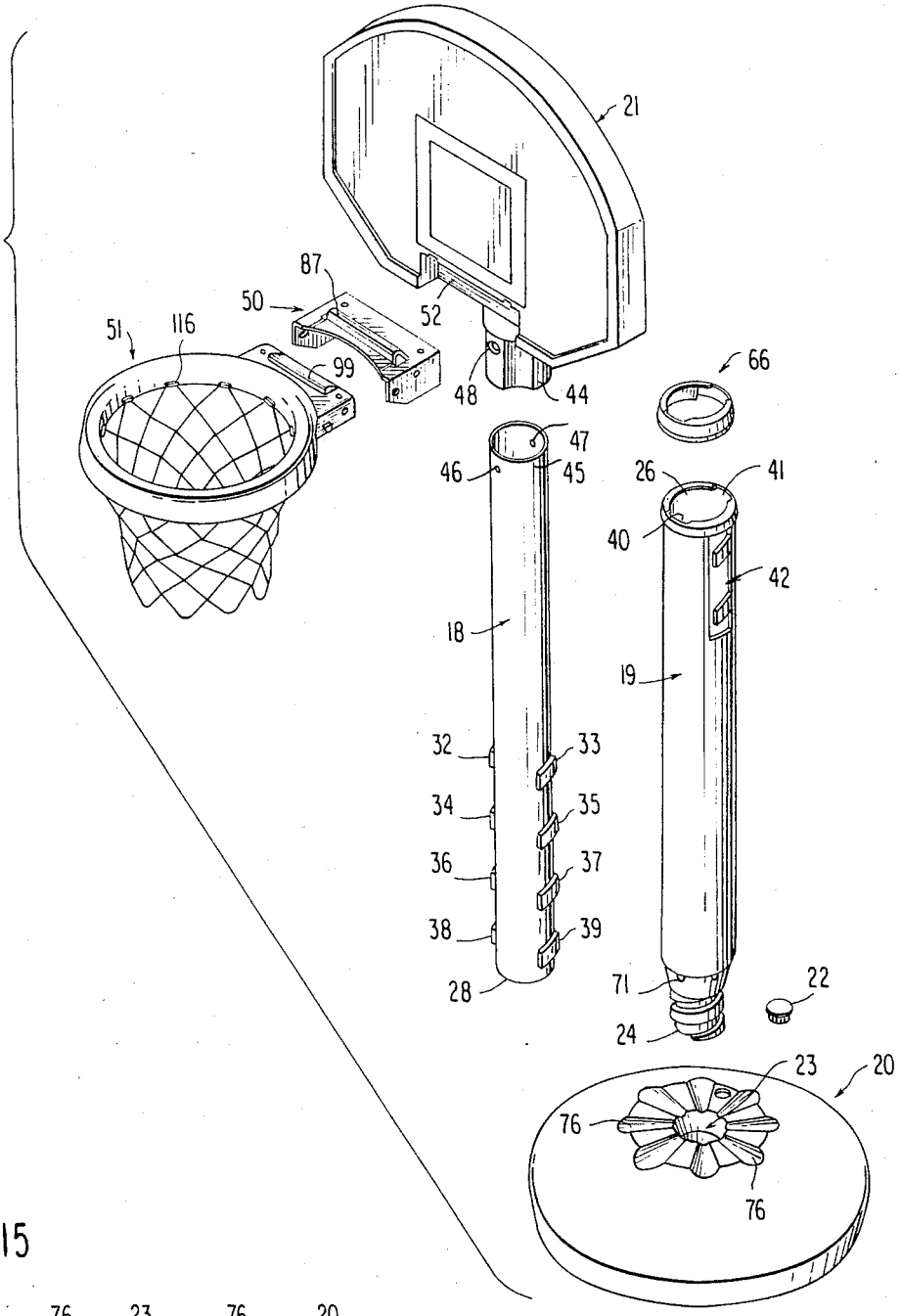
FIG. 2 is a perspective view of the disassembled toy showing the separable parts of the toy basketball goal set of FIG. 1 in juxtaposition to each other preparatory to assembly.

Elongated upright 17 (FIG. 1) comprises separable upper column 18 and lower column 19. Stabilizing base 20 with backboard structure 21 are interconnected by such upright 17.

The base 20 is hollow, can be formed of blow-molded plastic, and is unitary except for plug 22 (FIG. 2) which is provided for sealing a surface opening through which sand or other heavy material may be added to the hollow interior. Weighted base 20 and the lower longitudinal end of upright 17 are interconnected during assembly; e.g. in the specific embodiment illustrated, base 20 defines a threaded receptacle 23 for receiving threaded male connector 24 located at the lower longitudinal end of column 19.

The pair of columns 18, 19 forming elongated upright 17 are joined at their intermediate ends; their respective longitudinal ends interconnect with backboard 21 and base 20, respectively.

Figure 6:
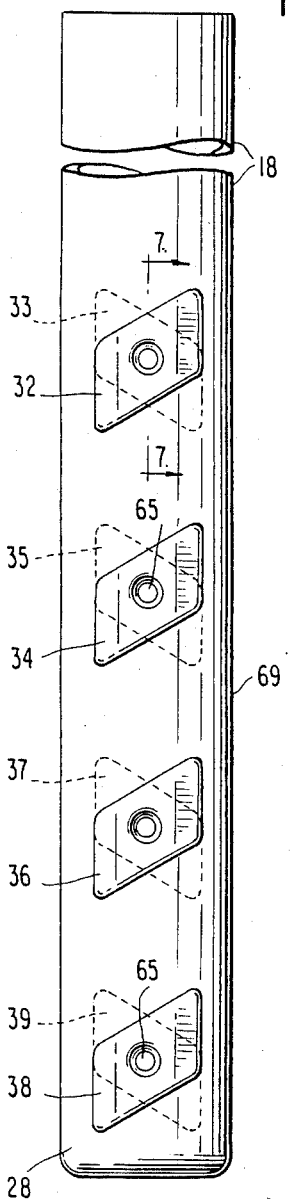
FIG. 6 is a detailed side view of another column of the elongated upright of the invention with portions on the opposite side shown in interrupted lines.

Upright 17, as formed from columns 18, 19, has a hollow, tubular, generally cylindrical configuration. Column 19 includes open end 26 (FIGS. 2, 3, 4 and 5) for telescopically receiving intermediate end 28 (FIGS. 2 and 6) of column 18.

Both columns 18 and 19 are hollow, tubular and of generally circular configuration in a cross-sectional plane perpendicular to their central longitudinal axes but, as described in more detail later, each includes unitary thread means along its diametrically opposite sides for adjusting the longitudinal length of upright 17 and for interlocking the columns 18, 19 to establish the height of such upright. Ease of adjustment and self-seating, rapid interlock of the columns, along with other advantages are provided by the interrupted helical threads feature of this invention.

Helically-oriented male, interrupted threads 32–39 (FIGS. 2, 6) are symmetrically located on the external cylindrical surface of column 18 longitudinally spaced from intermediate end portion 28. In the specific embodiment, such threads are distributed longitudinally in pairs at predetermined, uniformly-spaced levels along column 18. Such male threads present an external diameter enabling them to fit within the opening configuration of intermediate end 26 shown in FIGS. 2, 6. That opening includes diametrically opposite portions 40, 41, dimensionally equal to the full-internal diameter of the main body cylindrical portion of lower column 19, for receiving the male threads.

A pair, or pairs, of the interrupted male threads 32–39 interlock with female interrupted helical threads 42 (FIGS. 2, 3); such female threads are located contiguous to the open end 26 of the intermediate end portion of column 19.

Referring to FIG. 2, backboard structure 21 and the longitudinal end of the upper column 18 of elongated upright 17 are joined during assembly. In the specific embodiment illustrated, male member 44, which is a unitary part of backboard structure 21, fits into open end 45 of column 18. Male connector 44 can be locked in place by bolt means inserted through openings 46, 47 into threaded metal receptacles, such as 48, imbedded in the plastic material of such male member 44.

In the specific embodiment, bracket 50 for supporting hoop structure 51, interfits within a recessed contour 52 defined by the backboard structure; such recessed contour includes embedded threaded means for bolting the bracket 50 to the backboard structure, preferably on at least two surfaces of the contour 52. Interfitting of the hoop structure and the bracket means are described in more detail later herein.

The internal, helically-oriented, interrupted female threads of the specific embodiment, partially depicted at 42 of FIG. 2, are shown in more detail in the side view of FIG. 3, and the cross-sectional view of a portion of the lower column 19 shown in FIG. 4.

Thread means on the diametrically opposite side, from that shown in FIG. 3, are indicated by interrupted lines.

As shown by FIGS. 3 and 4, the interrupted female threads 56, 57 and 58, 59 open on the interior of the tubular column 19 for receiving the interrupted, helical-oriented male threads, selected from 32–39, which are disposed on the exterior surface of the upper column 18. The contour of the female threads projects radially outwardly in relation to the surrounding area 60; such surrounding area 60 is of circular configuration in a cross-sectional plane; but, is of lesser diameter than main body cylindrical wall surface 61 of lower column 19.

Each female thread entrance portion starts from such recessed cylindrical surface 60, and gradually increases in diameter by projecting outwardly toward the main body diameter of surface 61 where a blunt-end stop exists as the contour of the female thread abruptly returns to the lesser diameter of surrounding area 60.

The male threads on column 18 fit through enlarged diameter portions 40, 41 of intermediate end 26 (FIGS. 2 and 5), enabling end 28 to move into lower column 19. Upper column 18 can thus slide longitudinally within such lower hollow tubular column 19 when the male and female threads are not engaged; the interrupted male threads can thus move in a longitudinal direction between the interrupted female threads for purposes of adjusting and for establishing the height for the elongated upright 17.

Rotating upper column 18, through less than about 90 in the specific embodiment, when the male threads are aligned for entrance into the female threads, moves the male threads into the female threads. The longitudinal movement of the upper column 18 is very slightly downwardly during such rotation of the upper column 14 in relation to the lower column 19; this slight movement being due to the helical orientation of both sets of threads.

Leading edges of the male threads are preferably tapered radially to facilitate entrance. The male threads nest in the female threads against the blunt end of the latter.

It should be noted that, in the specific embodiment illustrated, both the female threads and the male threads have extended surface areas in the longitudinal direction. This configuration facilitates interlocking of the columns, adds strength for carrying the load—which is thus better distributed, and enables adding other features for increasing interlocking force. As a specific example of the latter, the interior surface areas of each female thread can include a radially-inwardly directed protrusion (such as 64, FIG. 4) for interfitting with an indentation (such as 65, FIGS. 6 and 7) in the outer surface of each male thread.

Figure 8:
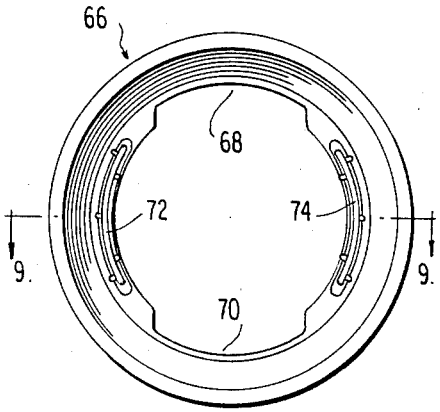
FIG. 8 is a bottom plan view of a column locking means of the invention.
Figure 9:
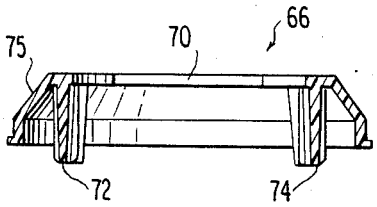
FIG. 9 is a cross-sectional view of the locking means of FIG. 9 taken along the line 9—9.
Figure 10:
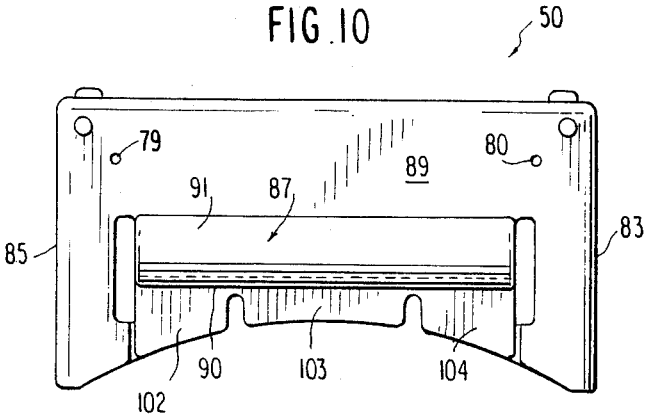
FIG. 10 is a top plan view of bracket means for releasably attaching hoop means to backboard means of the basketball goal structure of the invention.
Figure 11:
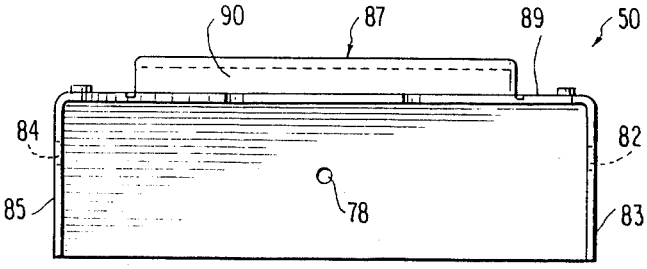
FIG. 11 is a front elevational view of the bracket means of FIG. 10.

The helical orientation and configuration of the male and female threads holds the upper column in position due to the weight of the upper column and the backboard. Additional stabilizing or interlocking is not essential but can be provided; one example is a cap lock 66 (FIGS. 2, 8, 9) having circumferentially-oriented downwardly-depending prongs which interfit into the open circumferential portions remaining at 40, 41 after rotation of upper column 18 within lower column 19; these prongs provide a further locking action to prevent accidental rotational movement of one column with respect to the other when the cap is in place.

Figure 7:
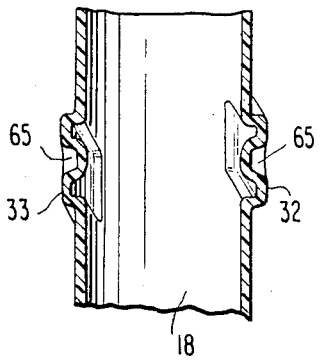
FIG. 7 is a cross-sectional view of a portion of the column of FIG. 6 taken along the plane 7—7.

Male threads 32–39 protrude from the external cylindrical surface 69 of the hollow tubular upper column 18 as indicated by the cross-sectional view of a portion of the male threads shown in FIG. 7.

During assembly, protruding male threads, such as 32 and 33 of FIG. 7, move through the enlarged opening portions 40, 41 of intermediate end 26 (FIG. 5) of column 18. This permits the column 18 to move axially within column 19 to establish the desired height. The diameter of enlarged opening portions 40, 41 is substantially equal to the enlarged diameter formed by the male threads 32–39. By alignment the protruding male threads of the upper column 18 can move through the interruptions in the female threads defined by the main body cylindrical surface 61 of column 19, as described earlier. The height adjustment for the backboard and hoop is thus determined. The columns are then held in place by relative rotational movement which interlocks the thread means due to the weight of the upper column and backboard structure. Also, as previously described, interlocking can be augmented by interfitting indentations and protrusions on the interrupted threads or other means, as shown.

The lower column 19 is preferably interlocked with the base means 20 in order to facilitate height adjustment at the intermediate ends of the interfitting columns. Protrusions, such as 71, at the longitudinal end of the main body cylindrical portion of lower column 19 (FIG. 3) interlock with radially-oriented recessed grooves, such as 76 (FIG. 2) so that threaded end 24 is resiliently interlocked into the threaded receiving means 23 of base 20. This helps avoid relative rotation between the lower column 19 and the upper column 18 when the male threads are being removed from the female threads for disassembly, or during height adjustments after assembly.

In the specific embodiment shown, the female helically-oriented interrupted threads are spaced longitudinally by about 4" along column 19; the pairs of helically-oriented male interrupted threads are similarly spaced along column 18. Generally, male threads at two longitudinally spaced locations will be utilized with the spaced pairs of female receiving threads; use of male threads at two longitudinally spaced locations will provide height adjustment up to 8" with the above 4" thread spacing designated for a specific embodiment. However, a single level pair of male threads 32, 33 can be utilized with the single lowermost pair of female threads; this provides suitable stability while increasing the vertical height adjustment another four (4) inches. Other longitudinal spacing arrangements can be provided for during fabrication provided levels are coordinated on the interfitting columns between the interrupted male and female threads. Height adjustments from about 10% to about 50% of the height of upright 17 are readily and quickly available while maintaining desired stability.

In the illustrated specific embodiment, the outer diameter of the main body cylindrical portion of lower column 19 is about 3.7" and the outer diameter of the main body cylindrical portion of upper column 18 is about 3". Radial depth of the helical female threads can be between about 0.25" to 0.35" and the protrusion of the male interrupted threads correspondingly has a radial dimension of about 0.25".

Typical thickness for a suitable plastic material, such as high density polyethylene, is about 0.075" to about 0.090" for the columns and the backboard structure; polypropylene or polyesters can also be used. The overall length of each column in the specific embodiment is about three feet.

In the bottom plan view of cap locking means 66 (FIG. 8) the enlarged diameter opening portions 68, 70 enable the locking means 66 to move longitudinally on upper column 14; i.e. portions 68, 70 provide space so that cap 66 can slide longitudinally over the male threads. The downwardly curved circumferential prongs 72, 74 (FIGS. 8 and 9 interfit into the space remaining at openings 40, 41 remaining at opening 26 after interlocking rotation of upper column 18 within lower column 19. Prongs 72, 74 prevent relative rotational movement between the columns when the lock cap 66 is in place. Surface 75 provides a cover for the otherwise exposed joint area.

An important feature of this invention involves an arrangement for securing the hoop structure means to the backboard means in a manner such that the hoop structure means can be temporarily and safely dislodged, i.e. the hoop for receiving a basketball can be moved downwardly from its normal playing position, while avoiding damage to the hoop or the backboard. This feature also avoids tilting of the entire structure in a forward direction, should a player impose too much weight on the hoop; e.g. as is sometimes observed in "slam-dunking" a basketball.

This dislodgment feature enables the hoop structure to be released, i.e. to "break-away", from a bracket structure which is used to attach the hoop means to the backboard, when a preselected force is applied to the hoop. Provision is made for manually returning the hoop structure to its playing position where it is manually snapped into place. Providing plastic materials and preselected configurations enable the "break-away" and manual "snap-back" return of the hoop structure to take place repeatedly without damage to the bracket, hoop, or backboard structure.

Bracket means 50 of FIGS. 2, 10, 11 and 12 is secured to the backboard structure 21 through openings 78 (FIG. 11) and 79, 80 (FIG. 10) using, for example, bolt means which thread onto metal liners imbedded in the plastic of the recessed contour 52 of backboard structure 21.

Aperture 82 in side wall 83 and aperture 84 in side wall 85 (FIG. 11), of bracket means 50, are provided for pivot-axis means which enable the hoop structure to pivot downwardly from its normal play position, e.g. bolt means extending through apertures 82, 84 provide for such pivoting. Snap-return apertures, such as 86 (FIG. 12) are also presented in the bracket side walls.

An upwardly-convex bar 87 (FIGS. 2, 10, 11 and 12) contributes to the preselected break-away pressure required for release of the hoop structure. Shaped bar 87 includes a curvalinear upper surface 88 (FIG. 12) joined with the remaining upper planar surface 89 of bracket means 50 by a perpendicular leg 90 and angled leg 91 (as best seen in FIG. 12). Shaped bar 87 and a portion of upper surface 89 flex to permit release and return of the hoop structure. The previously mentioned apertures, such as 86, in the side walls of the bracket means 50 also contribute to the "break-away" release and the "snap-return" interlocking of hoop structure in relation to the bracket means 50 which is secured to the backboard structure 21.

The portions of the hoop structure which coact with such specially shaped bar 87 and bracket side wall apertures, such as 86, are shown in FIG. 2 and numerically designated in FIGS. 13 and 14. Protruding buttons 94, 95, in side walls 96, 97 respectively of hoop flange 98, coact with apertures, such as 86 (FIG. 12), in the side walls 83, 85 of bracket means 50.

Hoop flange 98 (FIGS. 13 and 14) forms a unitary part of the hoop structure 51 which moves during such breakaway or return of the hoop structure within bracket side walls 83, 85 about pivot points 82, 84. Conventional bolt and nut means in the aligned pivot-axis apertures of the bracket and hoop flange side walls can be used to provide such pivot means.

As seen in FIG. 14, an upwardly-convex bar 99 which is a unitary part of hoop flange 98 has a cross-sectional shape corresponding to that of the specially shaped bar 87 (FIG. 12) on bracket means 50.

When the hoop structure 51 is in playing position with the hoop rim 100 horizontally disposed, the specially shaped bar 99 (on hoop flange 98, FIG. 14) is nested within correspondingly shaped bar 87 on bracket structure 50 (FIG. 12); buttons such as 94, 95 interfit into apertures such as 86 (FIG. 12); both the specially shaped bars and the interfitting buttons act to releasably hold the entire unitary hoop structure 51 (hoop flange 98 and the hoop rim 100) in playing position. Should a player clasp the hoop rim 100, and pull downwardly on it with sufficient force, buttons 94, 95 and shaped bar 99 are dislodged from their respective restraining means in bracket means 50 and the hoop structure rotates downwardly about the pivot-axis defined by points 82, 84.

The sidewalls of the bracket means 50 are flexed slightly outwardly by buttons 94, 95 during such pivoting; and portions of the upper surface of bracket means 50; especially apron portions 102, 103, 104 and portions of shaped bar 87, are flexed as shaped bar 99 moves from its nested position, or returns to its nested position, in shaped bar 87.

The hoop structure 51 is manually returned to its horizontal playing position by an upward force on hoop rim 100 so that shaped bar 99 of the hoop flange 98 is returned to its nested position. The bracket material flexes due to movement of the upper curvalinear surface shaped bar 99 against the interior of shaped bar 87. The protruding buttons 94, 95 slide into releasably locked position in snap-return apertures such as 86.

A flexible plastic with reasonable memory, such as polypropylene should be used for the bracket means 50. The hoop structure is preferably formed from an impact resistant polystyrene.

FIGS. 13, 14 are also used to show a more detailed configuration of the net string fasteners 106; such special-configuration fasteners are uniformly distributed about the interior diameter of structurally reinforced hoop rim 100. Such fasteners are unitary with hoop structure 51; each such fastener being unitary through a support arm, such as 108, which is centrally located in respect to cap portion 110 (providing a mushroom configuration in cross section). A protuberance is located on the rim-side surface of cap 110 on each side of arm 108, such protuberances are shown at 111, 112.

Net 114 (FIG. 2) has a plurality of support loops, such as 116, around its upper opening. To mount a loop, pressure is applied in a radial direction on one side of cap 110 which opens space between the opposite end protuberance, such as 111, and the interior diameter of hoop rim 100. One leg of a net support loop is inserted in this opening and the net string is looped over center support post 108; then by applying pressure on the other end of cap 110, space is opened between protuberances 112 and the interior diameter of hoop rim 100 for inserting the remaining leg of the net support loop.

String of slightly larger outer diameter (e.g. 0.125") than the normal space between protuberances, such as 111, 112, and the interior diameter of the hoop rim 100 is preferred for the net so that, after insertion of the legs, each support loop is held in position so as not to be dislodged during normal use, yet should be readily removable, if desired, during disassembly.

The string loops can also be mounted by pulling downwardly on both loop legs when a loop is in place since the outer diameter of the net string will diminish slightly, fitting into place inside the protuberances, such as 111, 112, as the loop is pulled downwardly over support arm 108. However, when a loop is in place it will not be removable in normal play action.

Figure 15:
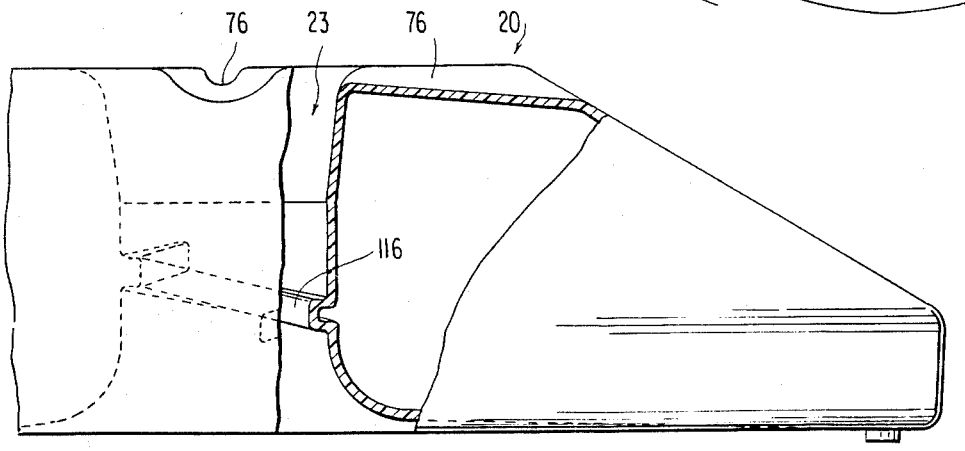
FIG. 15 is a partial cross-sectional view of the base means with portions cut away and recessed portions shown in interrupted lines.

In the detailed view of support base means 20 of FIG. 15, portions are cut away to show cross sectional configurations and certain recessed portions are shown by interrupted lines. Continuous helically oriented female thread 116 is positioned about the interior opening 23 for receiving the threaded end 24 of lower column 19. Radially-oriented grooves, such as 76, are located at the entrance of opening 23 for receiving nodules, such as 71 (FIG. 3); the latter releasably interlock column 19 and support base means 20.

The base means 20 is preferably blow molded using high density polyethylene or polypropylene; but can be injection molded from A.B.S.

Approximate dimensions typically used for the specific embodiment illustrated are:

| | |
|---|---|
| Base 14 | |
| Bottom Diameter | 19" |
| Horizontal Top Surface Diameter | 8" |
| Height | 5" |
| Hoop 100 | |
| Outer Diameter | 13" |
| Inner Diameter | 11" |
| Overall Length Hoop 100 and Flange 98 | 14.6" |
| Backboard Structure 21 | |
| Overall Height Including | |
| Connector Legs 44 | 22" |
| Overall Width | 22" |
| Connector Leg 44 Diameter | 5" |
| Depth of Backboard | 1" |
| Thickness Gage of | .125" |

-continued

| |
|---|
| Backboard Plastic |

While specific dimensions, materials and data have been disclosed, and specific configurations illustrated, it should be recognized that in the light of the above teachings, modifications to these specifics would be available to those skilled in the art; therefore, it is understood that the scope of the present invention is to be determined by reference to the appended claims.

I claim:

1. Portable, lightweight-construction, toy basketball goal structure with yieldably interfitted plastic parts capable of relative movement to prevent damage thereto during execution of a slam dunk play, comprising basketball backboard means presenting a generally planar backboard playing surface and a recessed contour presenting an opening facing in a direction normal to such planar backboard playing surface, hoop means associated with such backboard means, such hoop means having a generally toroidal configuration with a hoop, which is circular in plan view, and a unitary hoop flange extending radially outwardly at a single location about the circumference of such hoop, bracket means for:

(a) yieldably positioning such hoop means in relation to such backboard means to dispose such circular hoop in horizontally-oriented play position, (b) releasing such hoop means to permit angular movement of such hoop means relative to such backboard means so as to rotate such hoop from its horizontally-oriented play position to an out-of-play position when a predetermined downwardly-directed force, such as that from execution of a slam dunk play, is exerted on such hoop, and (c) yieldably permitting oppositely directed angular relative movement of such hoop means to manually return such hoop means from such out-of-play position to such horizontally-oriented play position, such bracket means acting between such backboard means and such hoop means to enable such relative angular movement, and means for securing such bracket means within such recessed contour of the backboard means.

2. The structure of claim 1 in which such bracket means and hoop flange have interfitting configurations, with such bracket means as secured in such recessed contour of such backboard means presenting an opening facing in a direction normal to such planar backboard playing surface for receiving such hoop flange which is interfitted within such bracket means opening.

3. A basketball goal for support on a support structure having a basketball backboard attached thereto, comprising:

a hoop means having a generally toroidal configuration and including a hoop, said hoop being circular in plan view, and a unitary hoop flange extending radially outwardly at a single location about the circumference of said hoop;

bracket means attached to said support means for supporting said hoop means adjacent to said backboard, said bracket yieldably positioning said hoop means in relation to said backboard to dispose said hoop in a horizontally-oriented play position, said bracket being configured to release said hoop means to permit angular movement of said hoop means relative to said backboard so as to rotate said hoop from its play position to an out-of-play position when a predetermined downwardly directed force is exerted on said hoop, said bracket also yieldably permitting oppositely directed angular movement of said hoop means to manually return said hoop from said out-of-play position to said play position;

said bracket means and said hoop flange having matching configurations providing for nesting of said hoop flange within said bracket means when said hoop means is moved into position with said hoop in said play position during which said hoop flange is yieldably interlocked within said bracket means;

said bracket means and said hoop flange each including a generally horizontally-oriented wall in a plane substantially parallel to the plane of said hoop when in its play position and, a generally vertically extending side wall for each lateral side of said horizontally-oriented walls of said bracket means and said hoop flange;

such bracket means and hoop flange side walls each including means which interact to enable such hoop means to hold said hoop in said play position, to allow said hoop to be dislodged from said play position and to be returned to said yieldably interlocked nested position in which said hoop is in said play position;

said side walls including cooperating aperture means and protruding button means which interfit when said hoop is in said play position and which are yieldably released from said interfitted relationship to allow said hoop to be moved to said out-of-play position when said downwardly-directed force is applied to said hoop.

4. The structure of claim 3 in which such generally-horizontally-oriented wall of such bracket means and hoop flange each include curvilinear surface protruding means which interact to allow said hoop flange to hold such hoop in such play position and yieldably interact to enable such hoop flange to be dislodged from its nested position and then to be yieldably returned to such interlocked nested position in which such circular hoop is in its horizontally-oriented play position, such curvilinear-surface protruding means coacting to resist such dislodgment and return by resilient flexing of portions of such horizontally-oriented wall of the bracket means during movement of the hoop flange out of or into its nested position.

5. Apparatus for supporting a basketball net having upwardly extending loops on a circular basketball hoop, comprising:

a plurality of protuberances attached symmetrically to said hoop about the diametrical inner surface thereof;

each such protuberance having a "T" shaped configuration in horizontal cross section with the stem of such "T" shaped configuration being attached to such inner surface and oriented in a radially inward direction for receiving an individual loop of said net thereon, the cross leg of such "T" shaped configuration providing means for retaining a leg of a loop on each peripheral side of such "T" shaped configuration stem.

* * * * *